US006109531A

United States Patent [19]

Hollis

[11] Patent Number: 6,109,531

[45] Date of Patent: Aug. 29, 2000

[54] HIGH RELIABILITY HEATING SYSTEM

[76] Inventor: Brien Hollis, G-8196 N. Dort Hwy., Mt. Morris, Mich. 48458

[21] Appl. No.: 09/199,100

[22] Filed: Nov. 24, 1998

[51] Int. Cl.[7] ..... G05D 23/00; F24F 3/00

[52] U.S. Cl. ..... 236/10; 236/1 A; 236/78 A; 165/205

[58] Field of Search ..... 236/10, 78 R, 236/1 R, 78 A, 1 EB, 1 A; 165/205, 208

[56] References Cited

U.S. PATENT DOCUMENTS

| | | | |
|---|---|---|---|
| 1,560,377 | 11/1925 | Daley . | |
| 2,008,963 | 7/1935 | Mack | 219/39 |
| 2,022,453 | 11/1935 | Ball | 219/38 |
| 2,269,036 | 1/1942 | Nessell | 165/205 X |
| 2,893,639 | 7/1959 | Martin | 237/2 |
| 3,280,297 | 10/1966 | Folmar | 219/201 |
| 4,434,782 | 3/1984 | Traeger | 126/116 C |
| 4,805,689 | 2/1989 | Inada et al. | 165/29 |
| 4,840,220 | 6/1989 | Umezu et al. | 165/1 |
| 4,976,459 | 12/1990 | Lynch | 236/1 EB |
| 5,239,838 | 8/1993 | Tressler | 62/324.1 |
| 5,332,028 | 7/1994 | Marris | 165/1 |
| 5,337,952 | 8/1994 | Thompson | 236/10 |
| 5,367,601 | 11/1994 | Hannabery | 392/307 |
| 5,533,568 | 7/1996 | Schuster et al. . | |

*Primary Examiner*—William Wayner
*Attorney, Agent, or Firm*—Joseph N. Breaux

[57] ABSTRACT

A high reliability heating system that includes dual furnace control mechanisms wherein each furnace control mechanism includes blowers and control elements and each is independently operable to control the operation of a shared furnace burner unit and heat exchanger. The heating system preferably includes a controller mechanism selector mechanism that detects an abnormal operating condition, malfunction, in the controlling furnace controller mechanism and, in response, automatically switches control to the other furnace controller mechanism.

2 Claims, 5 Drawing Sheets

HIGH RELIABILITY HEATING SYSTEM

TECHNICAL FIELD

The present invention relates to heating systems for buildings and more particularly to a high reliability heating system including a dual furnace control mechanism that controls the operation of a shared furnace burner unit and heat exchanger; the dual furnace control mechanism includes a controller board selector relay having a relay control input, first and second sets of power switching contacts, and first and second sets of thermostat control signal switching contacts; and first and second controller boards; each of the first and second controller boards having a status LED output that generates a normal operation output signal and an abnormal operation output signal; the first controller board having a power input wired through the first set of power switching contacts of the controller board selector relay and being in signal receiving connection with a first upper limit sensing unit having an upper limit switch and an auxiliary upper limit switch wired in series, a first negative pressure controller, a first flame sensor, and a first thermostat control signal; and in controlling connection with a first main gas valve assembly including a number of series connected roll out switches and a first main gas control valve, a first draft inducer blower having a vacuum connection connected to a vacuum controlled control input of the first negative pressure controller, a first main blower, and a first hot surface ignitor; the second controller board having a power input wired through the second set of power switching contacts of the controller board selector relay and being in signal receiving connection with a second upper limit sensing unit having an upper limit switch and an auxiliary upper limit switch wired in series, a second negative pressure controller, a second flame sensor, and a second thermostat control signal; and in controlling connection with a second main gas valve assembly including a number of series connected roll out switches and a second main gas control valve, a second draft inducer blower having a vacuum connection connected to a vacuum controlled control input of the second negative pressure controller, a second main blower, and a second hot surface ignitor; the relay control input of the controller board selector relay being in controlled connection with the status LED output of the first controller board such that when the first controller board status LED output generates an abnormal operation output signal, such as when a system component fails, the controller board selector relay disconnects the first controller board from the first thermostat control signal and supply power in response to the abnormal operation output signal and connects the second controller board with supply power and the second thermostat control signal switching control of the furnace burner unit and heat exchanger to the second controller board.

BACKGROUND ART

The failure of a building heating system during extreme cold, such as in a blizzard, can endanger the lives of the building occupants as well as lead to expensive property damage and expensive emergency repair bills. Although heating systems can fail for a variety of reasons, perhaps the least likely components of a heating system to fail are the furnace burner unit that generates the heat and the heat exchanger that uses the heat generated by the furnace burner unit to warm the air transmitted into the building rooms through the duct system. Heating systems typically fail when one of the blowers or one of the control elements fails.

It would be a benefit, therefore, to have a heating system that included dual furnace control mechanisms each including its own blowers and control elements that could each independently control the operation of a shared furnace burner unit and heat exchanger so that when one of the furnace control mechanisms malfunctioned, the remaining furnace control mechanism could be placed into service restoring heat to the building preventing injury to the building occupants and property damage, such as broken pipes, to the building. With the heating system still in operation, non-emergency repairs could be made to the malfunctioning furnace control mechanism during normal business hours or, if required, when financial circumstances allowed. Because malfunctions can occur in an unoccupied building and many individuals could find it difficult to manually switch from one furnace control system to another, it would be a further benefit to have a controller mechanism selector mechanism for detecting an abnormal operating condition, malfunction, in the controlling furnace controller mechanism and automatically switching control to the other furnace controller mechanism which provides an indicator to alert the user that service is required for the malfunctioning furnace control mechanism.

GENERAL SUMMARY DISCUSSION OF INVENTION

It is thus an object of the invention to provide a high reliability heating system that includes dual furnace control mechanisms wherein each furnace control mechanism includes blowers and control elements and each is independently operable to control the operation of a shared furnace burner unit and heat exchanger.

It is a further object of the invention to provide a high reliability heating system that includes dual furnace control mechanisms and a controller mechanism selector mechanism that detects an abnormal operating condition, malfunction, in the controlling furnace controller mechanism and, in response, automatically switches control to the other furnace controller mechanism.

It is a still further object of the invention to provide a high reliability heating system that includes a controller board selector relay having a relay control input, first and second sets of power switching contacts, and first and second sets of thermostat control signal switching contacts; and first and second controller boards; each of the first and second controller boards having a status LED output that generates a normal operation output signal and an abnormal operation output signal; the first controller board having a power input wired through the first set of power switching contacts of the controller board selector relay and being in signal receiving connection with a first upper limit sensing unit having an upper limit switch and an auxiliary upper limit switch wired in series, a first negative pressure controller, a first flame sensor, and a first thermostat control signal; and in controlling connection with a first main gas valve assembly including a number of series connected roll out switches and a first main gas control valve, a first draft inducer blower having a vacuum connection connected to a vacuum controlled control input of the first negative pressure controller, a first main blower, and a first hot surface ignitor; the second controller board having a power input wired through the second set of power switching contacts of the controller board selector relay and being in signal receiving connection with a second upper limit sensing unit having an upper limit switch and an auxiliary upper limit switch wired in series, a second negative pressure controller, a second flame sensor, and a second thermostat control signal; and in controlling connection with a second main gas valve assembly including a number of series connected roll out switches and a second main gas control valve, a second draft inducer blower having a vacuum connection connected to a vacuum controlled control input of the second negative pressure controller, a second main blower, and a second hot surface ignitor; the relay control input of the controller board selector relay being in controlled connection with the status LED output of the first controller board such that when the first controller board status LED output generates an abnormal operation output signal, such as when a system component fails, the controller board selector relay disconnects the first controller board from the first thermostat control signal and supply power in response to the abnormal operation output signal and connects the second controller board with supply power and the second thermostat control signal switching control of the furnace burner unit and heat exchanger to the second controller board.

It is a still further object of the invention to provide a high reliability heating system that accomplishes some or all of the above objects in combination.

Accordingly, a high reliability heating system is provided. The high reliability heating system includes a controller board selector relay having a relay control input, first and second sets of power switching contacts, and first and second sets of thermostat control signal switching contacts; and first and second controller boards; each of the first and second controller boards having a status LED output that generates a normal operation output signal and an abnormal operation output signal; the first controller board having a power input wired through the first set of power switching contacts of the controller board selector relay and being in signal receiving connection with a first upper limit sensing unit having an upper limit switch and an auxiliary upper limit switch wired in series, a first negative pressure controller, a first flame sensor, and a first thermostat control signal; and in controlling connection with a first main gas valve assembly including a number of series connected roll out switches and a first main gas control valve, a first draft inducer blower having a vacuum connection connected to a vacuum controlled control input of the first negative pressure controller, a first main blower, and a first hot surface ignitor; the second controller board having a power input wired through the second set of power switching contacts of the controller board selector relay and being in signal receiving connection with a second upper limit sensing unit having an upper limit switch and an auxiliary upper limit switch wired in series, a second negative pressure controller, a second flame sensor, and a second thermostat control signal; and in controlling connection with a second main gas valve assembly including a number of series connected roll out switches and a second main gas control valve, a second draft inducer blower having a vacuum connection connected to a vacuum controlled control input of the second negative pressure controller, a second main blower, and a second hot surface ignitor; the relay control input of the controller board selector relay being in controlled connection with the status LED output of the first controller board such that when the first controller board status LED output generates an abnormal operation output signal, such as when a system component fails, the controller board selector relay disconnects the first controller board from the first thermostat control signal and supply power in response to the abnormal operation output signal and connects the second controller board with supply power and the second thermostat control signal switching control of the furnace burner unit and heat exchanger to the second controller board. The terms first and second draft inducer blowers as used herein include the common use of a single blower cage powered by a shaded pole electric motor having two independently energized coils on a single shaft coupled to the single blower cage, one coil being controlled by each controller board and each coil when energized independently rotating the shaft to power the blower cage. When first and second draft inducer blowers conforming to this description are used, connection with the flue is simplified and the furnace housing is more easily used in any orientation. It should also be pointed out that the use of the high reliability heating system of the present invention will not effect the efficiency of the furnace unit used.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
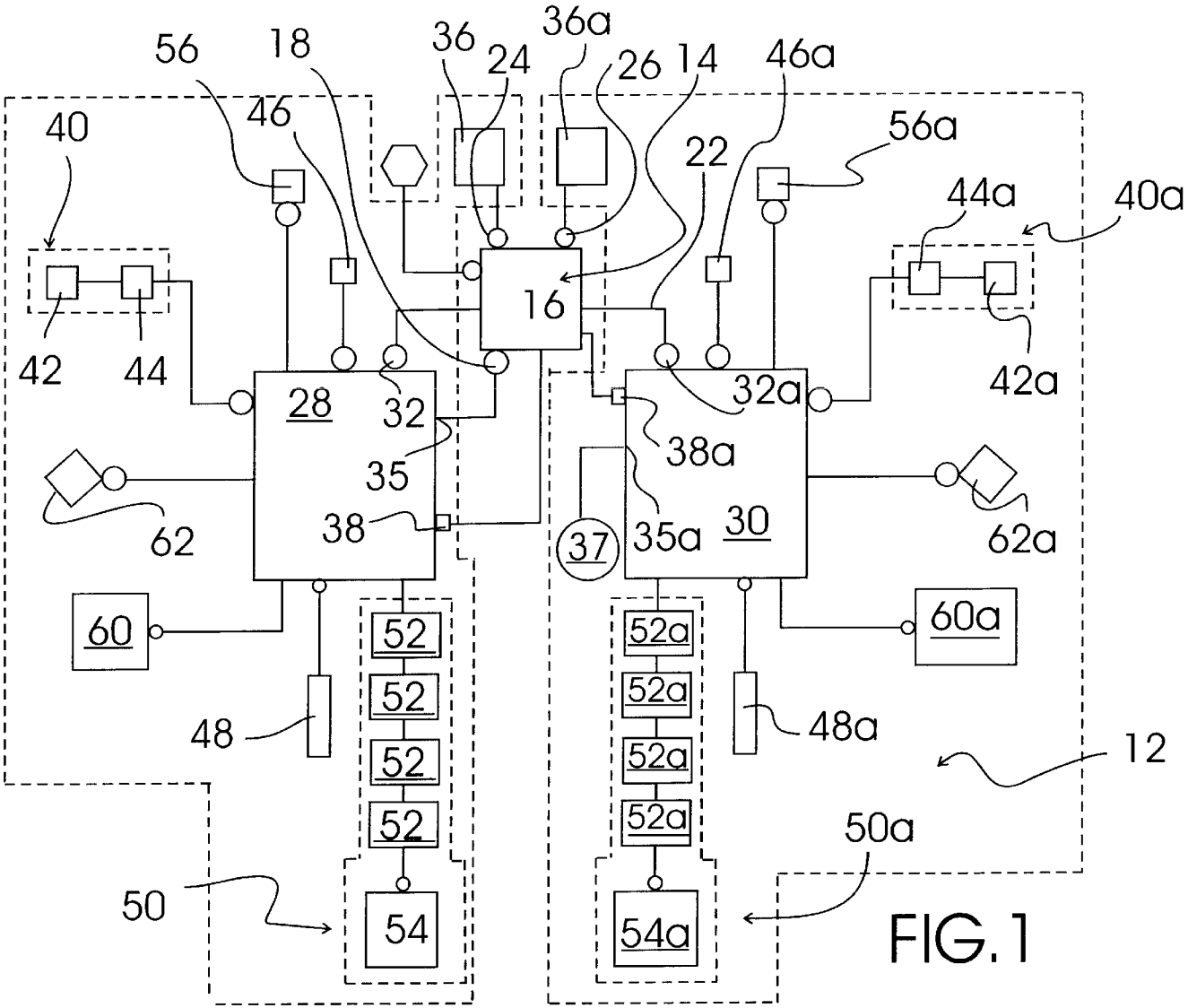
FIG. 1 is a schematic diagram of the dual furnace control mechanism of the high reliability heating system of the present invention showing the controller board selector relay having a relay control input, first and second sets of power switching contacts, and first and second sets of thermostat control signal switching contacts; and the first and second controller boards of the first and second furnace control mechanisms; each of the first and second controller boards having a status LED output that generates a normal operation output signal and an abnormal operation output signal; the first controller board having a power input wired through the first set of power switching contacts of the controller board selector relay and being in signal receiving connection with a first upper limit sensing unit having an upper limit switch and an auxiliary upper limit switch wired in series, a first negative pressure controller, a first flame sensor, and a first thermostat control signal; and in controlling connection with a first main gas valve assembly including a number of series connected roll out switches and a first main gas control valve, a first draft inducer blower having a vacuum connection connected to a vacuum controlled control input of the first negative pressure controller, a first main blower, and a first hot surface ignitor; the second controller board having a power input wired through the second set of power switching contacts of the controller board selector relay and being in signal receiving connection with a second upper limit sensing unit having an upper limit switch and an auxiliary upper limit switch wired in series, a second negative pressure controller, a second flame sensor, and a second thermostat control signal; and in controlling connection with a second main gas valve assembly including a number of series connected roll out switches and a second main gas control valve, a second draft inducer blower having a vacuum connection connected to a vacuum controlled control input of the second negative pressure controller, a second main blower, and a second hot surface ignitor; the relay control input of the controller board selector relay being in controlled connection with the status LED output of the first controller board such that when the first controller board status LED output generates an abnormal operation output signal the controller board selector relay disconnects the first controller board from the first thermostat control signal and supply power and connects the second controller board with supply power and the second thermostat control signal.

FIG. 1 schematically shows an exemplary embodiment of the first and second furnace control mechanisms, generally designated 10 and 12, respectively, and an exemplary controller mechanism selector mechanism, generally designated 14, of the high reliability heating system of the present invention. In this embodiment, controller mechanism selector mechanism 14 includes a controller board selector relay 16 having a relay control input 18, first and second sets of power switching contacts 20,22, and, first and second sets of thermostat control signal switching contacts 24,26. First and second furnace control mechanisms 10,12 each include, respectively, a first and a second controller board 28,30 that are identical commercially available heater control boards manufactured by Goodman Manufacturing, PN AB1001-3A and having a status LED output that generates a continuous voltage level normal operation output signal and a square wave voltage level abnormal operation output signal.

First controller board 28 has a power input 32 wired through the first set of power switching contacts 20 of controller board selector relay 16 and has a first status LED output 35 connected to relay control input 18 of controller board selector relay 16. When first controller board 28 is in normal operation, first set of power switching contacts 20 and first set of thermostat control signal switching contacts 24 are closed and second set of power switching contacts 22 and second set of thermostat control signal switching contacts 26 are open. First thermostat control signals from a first thermostat 36 are connected to first controller board 28 through a thermostat input 38 wired to the first set of thermostat control signal switching contacts 24.

First controller board 28 is in signal receiving connection with a first upper limit sensing unit, generally designated 40, having an upper limit switch 42 and an auxiliary upper limit switch 44 wired in series; a first negative pressure controller 46; a first flame sensor 48; and the first thermostat control signal. First controller board 28 is in controlling connection with a first main gas valve assembly, generally designated 50, including four series connected roll out switches 52 and a first main gas control valve 54; a first draft inducer blower 56 having a vacuum connection connected to a vacuum controlled control input 58 (FIG. 3) of first negative pressure controller 46; a first main blower 60; and a first hot surface ignitor 62.

Second controller board 30 has a power input 32*a* wired through the second set of power switching contacts 22 of controller board selector relay 16 and has a second status LED output 35*a* connected to a status LED 37. Second controller board 30 receives second thermostat control signals from a second thermostat 36*a* through a thermostat input 38*a* wired to the second set of thermostat control signal switching contacts 26.

Second controller board 30 is in signal receiving connection with a second upper limit sensing unit, generally designated 40*a,* having an upper limit switch 42*a* and an auxiliary upper limit switch 44*a* wired in series; a second negative pressure controller 46*a;* a second flame sensor 48*a;* and the second thermostat control signal from second thermostat 36*a*. Second controller board 30 is in controlling connection with a second main gas valve assembly, generally designated 50*a,* including four series connected roll out switches 52*a* and a second main gas control valve 54*a;* a second draft inducer blower 56*a* having a vacuum connection connected to a vacuum controlled control input 58*a* (FIG. 3) of second negative pressure controller 46*a;* a second main blower 60*a;* and a second hot surface ignitor 62*a*.

Figure 2:
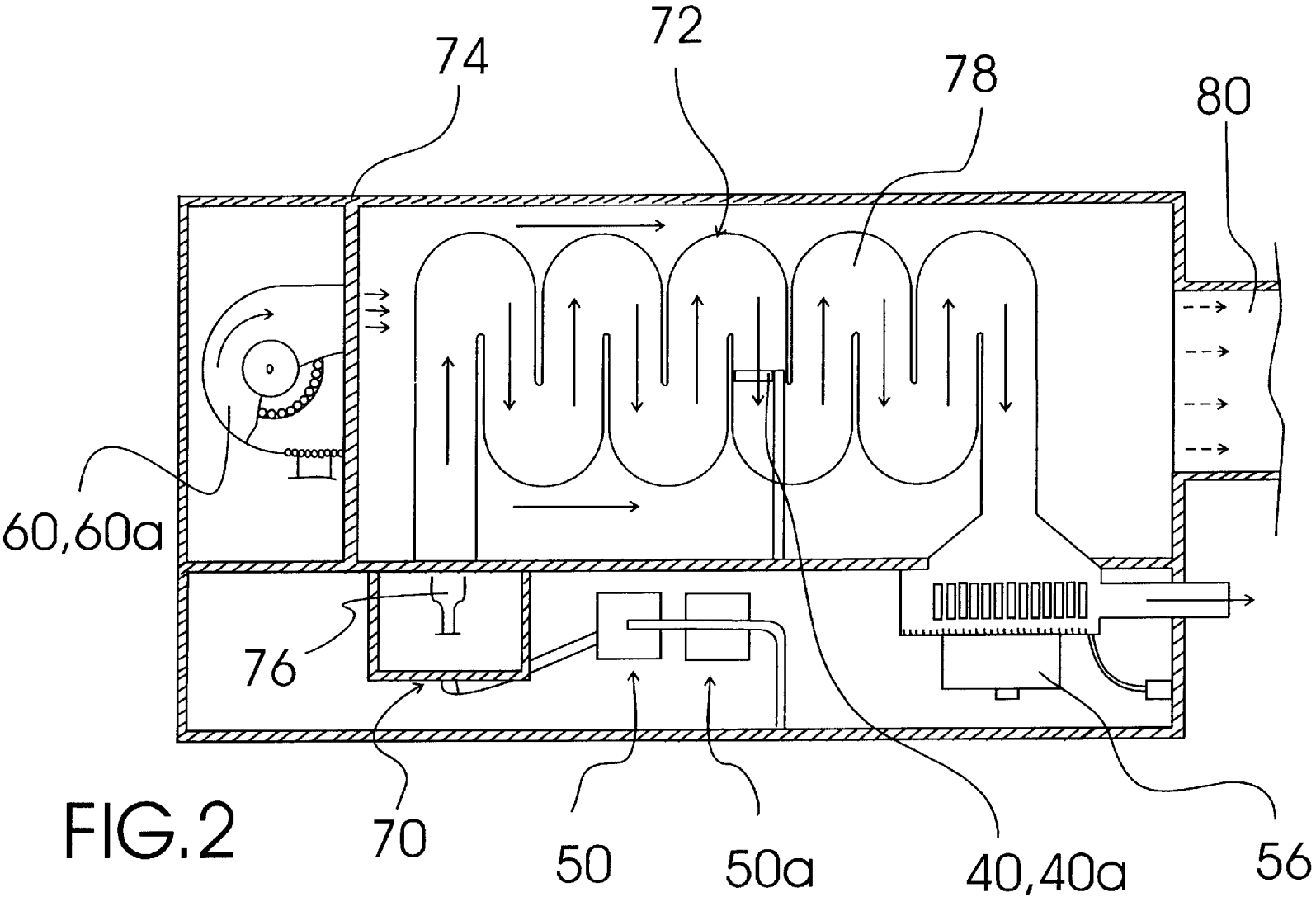
FIG. 2 is a schematic diagram showing a representative furnace burner unit in connection with the first and second main gas valve assemblies; the furnace heat exchanger in direct connection between the furnace burner unit and the first and second draft inducer blowers; the first and second upper limit sensing assemblies installed within the furnace heat exchanger; and the first and second blowers positioned within the furnace housing and flowing air over the furnace heat exchanger and out to the building through the HVAC duct system.
Figure 3:
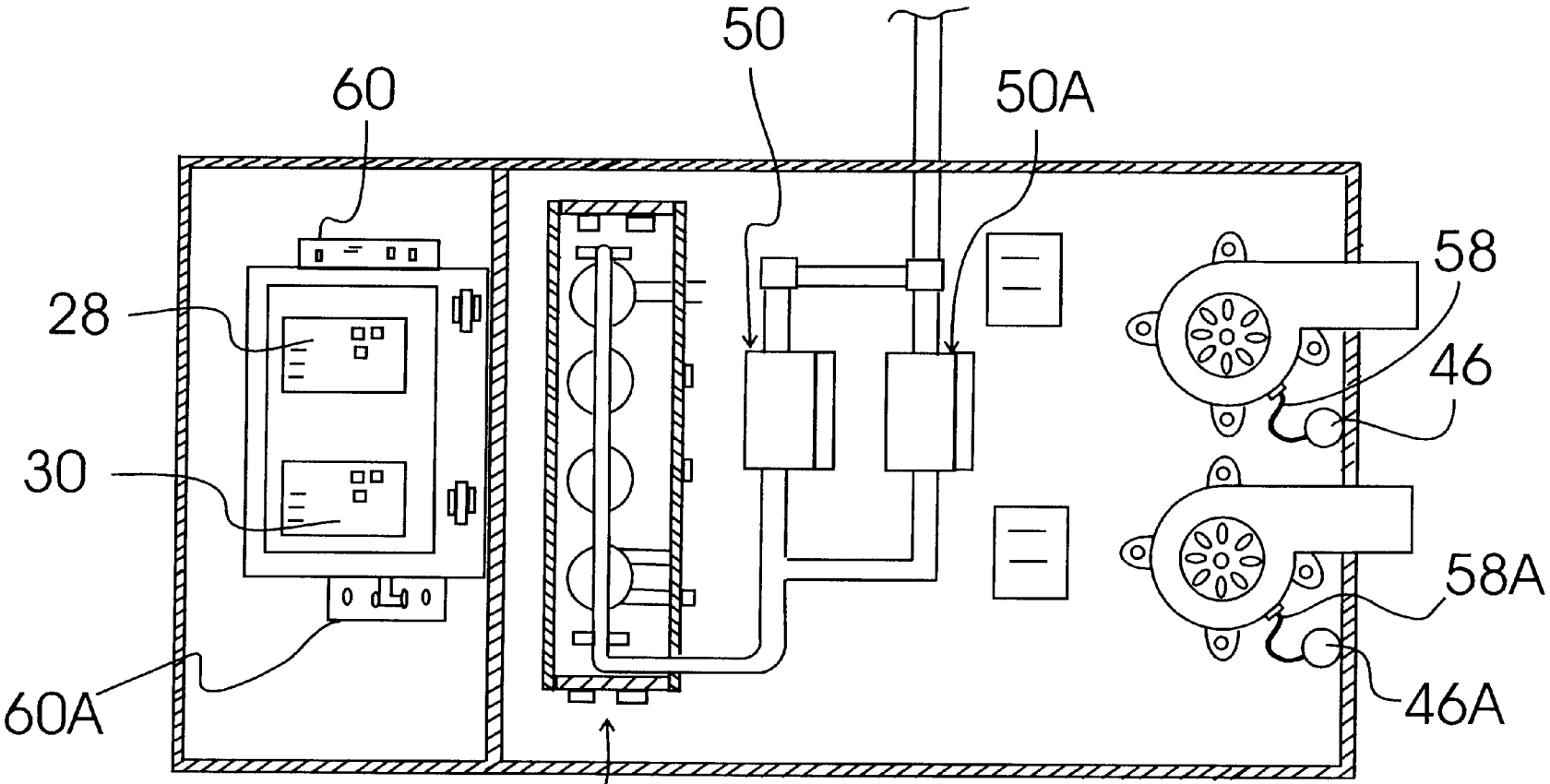
FIG. 3 is another schematic diagram showing the representative furnace burner unit in connection with the parallel connected first and second main gas valve assemblies; the first and second draft inducer blowers in connection with, respectively, the first and second negative pressure controller; the first and second controller boards, and the first and second blowers positioned within the furnace housing.

FIGS. 2 and 3 show schematically a representative furnace burner unit, generally designated 70; a representative heat exchanger unit, generally designated 72, having a combustion passageway 78; and a representative furnace housing 74. Furnace burner unit 70 includes four burners 76 (only one shown, see also FIG. 4) that are in connection with parallel connected first and second main gas valve assemblies 50,50*a*. During operation, flames from burners 76 are pulled through the combustion passageway 78 of heat exchanger 72 by operation of either first or second draft inducer blowers 56,56*a,* depending on which furnace control mechanism 10,12 (FIG. 1) is in operation. First and second upper limit sensing assemblies 40,40*a* are installed within combustion passageway 78 and provide an overlimit signal to first and second controller boards 28,30, respectively. First and second blowers 60,60*a* are positioned within furnace housing 74 and blow air over the exterior of furnace heat exchanger 72 and out to the building through the HVAC duct system 80.

Figure 4:
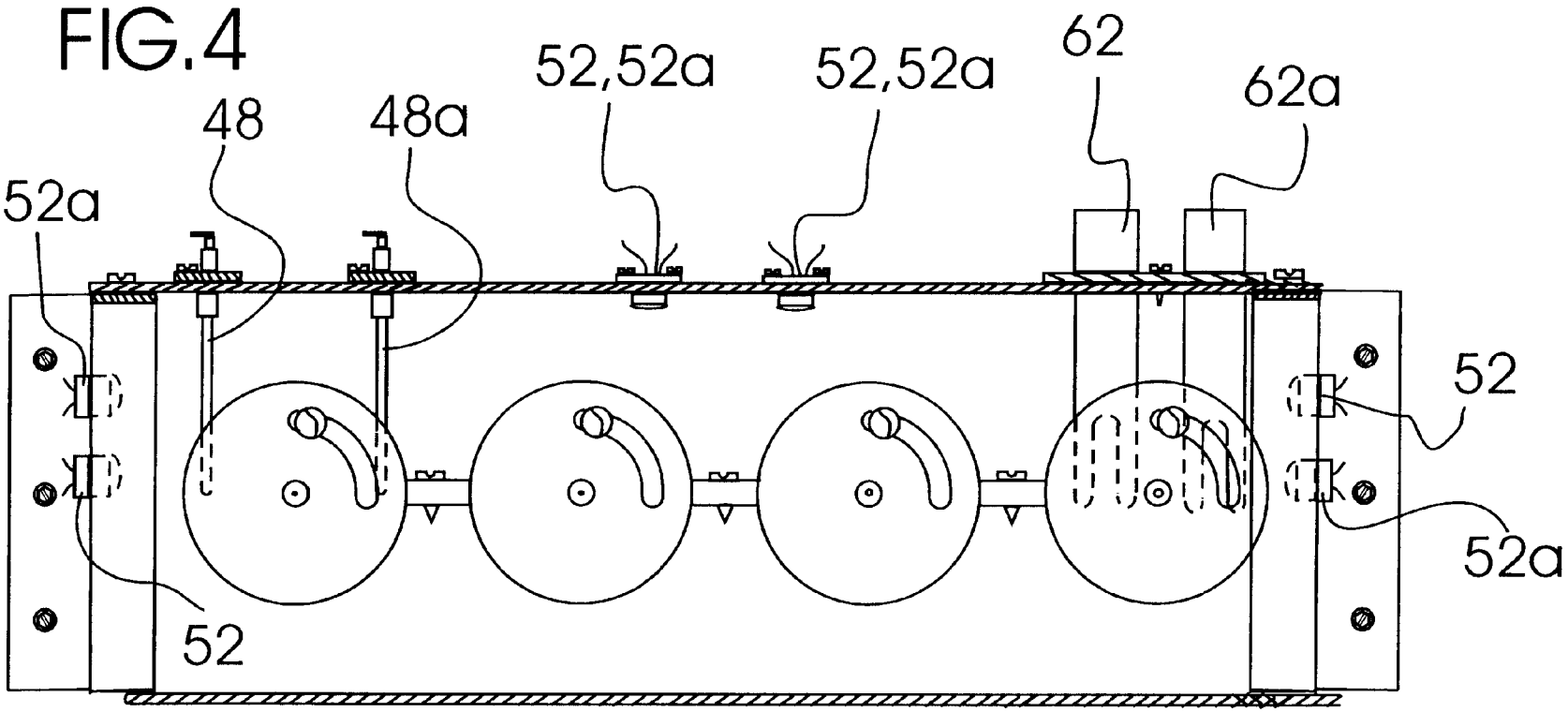
FIG. 4 is a schematic detail view showing four burners of the representative furnace burner unit, the first and second flame sensors, the first and second sets of roll out switches, respectively, of the first and second main gas valve assemblies; and the first and second heated surface ignitor.

Referring to FIG. 4, furnace burner unit 70 has four burners 76 that are connected to a gas intake manifold. First and second flame sensors 48,48*a;* first and second sets of roll out switches 52,52*a;* and first and second heated surface ignitor 62,62*a* are positioned in connection with furnace burner unit 70 adjacent to their respective counterparts and are utilized when their respective furnace control mechanism 10,12 (FIG. 1) is operational.

Figure 5:
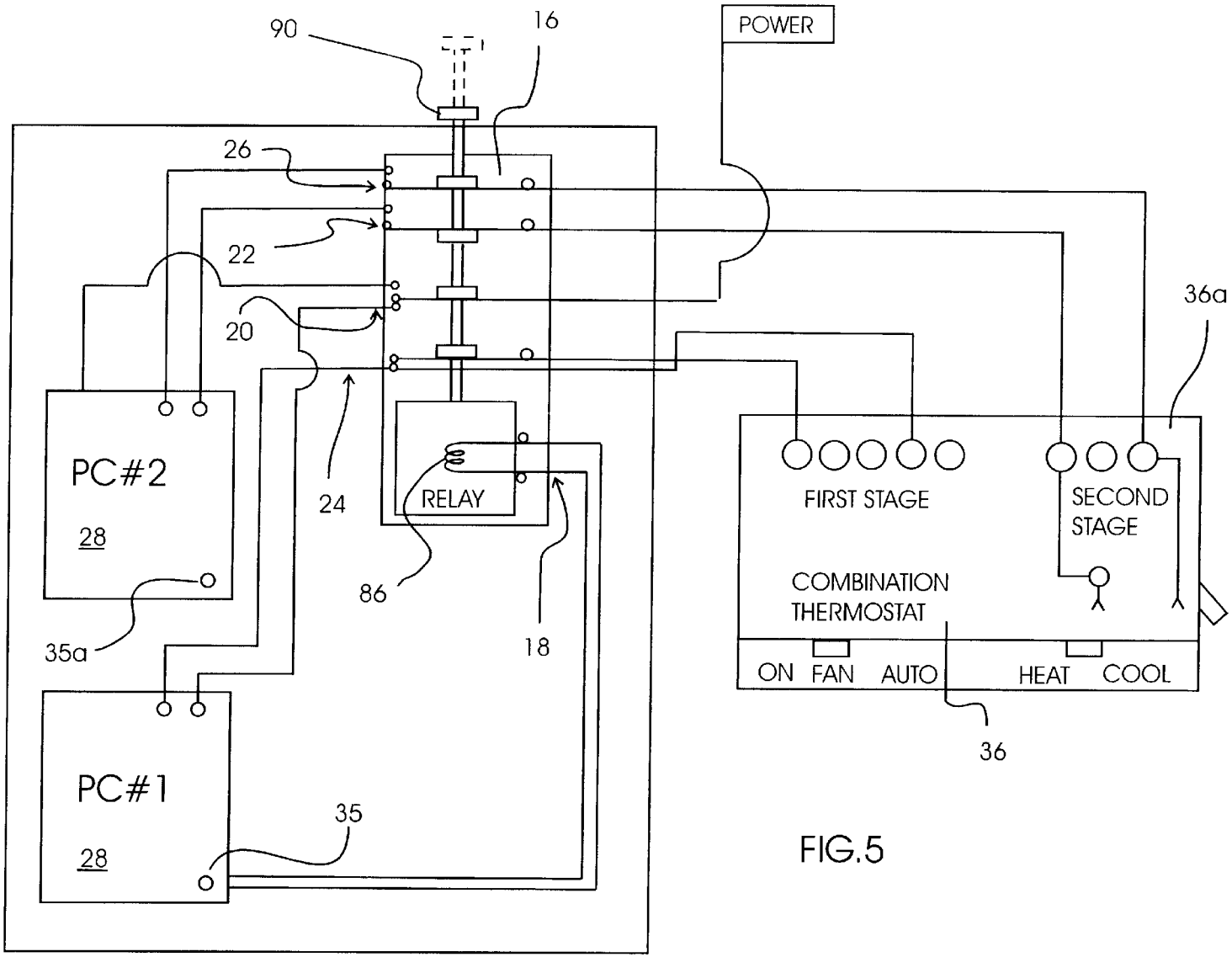
FIG. 5 is schematic diagram showing the controller board selector relay with the relay control input wired to the status LED output of the first controller board; first and second sets of power switching contacts wired between the power supply and the first and second controller boards; the first set of thermostat control signal switching contacts wired between the first stage of the combination thermostat and the thermostat inputs of the first controller board; and the second set of thermostat control signal switching contacts wired between the second stage of the combination thermostat and the thermostat inputs of the second controller board.

Referring to FIG. 5, it can be seen from the foregoing descriptions that furnace control mechanisms 10,12 (FIG. 1) are of substantially identical construction and makeup with the primary difference being the connection of the first and second status LED outputs 35,35*a*. As described herein before, first controller board 28 generates a continuous voltage level at its first status LED output 35 energizing the relay coil 86 of controller mechanism selector relay 16 and maintaining first set of power switching contacts 20 and first set of thermostat control signal switching contacts 24 in the closed state and second set of power switching contacts 22 and second set of thermostat control signal switching contacts 26 in the open state. When relay coil 86 is energized by a continuous voltage level from the first status LED output 35, the first controller board 28 is enabled and the second controller board 30 is disabled. Should first control mechanism 10 (FIG. 1) develop a malfunction, first controller board 28 generates a square wave voltage output at first status LED output 35 that has a duty cycle insufficient to adequately energize relay coil 86 allowing a spring within controller mechanism selector relay 16 to mechanically switch the first set of power switching contacts 20 and the first set of thermostat control signal switching contacts 24 into the open state and the second set of power switching contacts 22 and the second set of thermostat control signal switching contacts 26 into the closed state, and thereby disables first furnace control mechanism 10 and activates second furnace controller mechanism 12. In this embodiment, a mechanism reset button 90 must be depressed to switch back to first furnace control mechanism 10.

It can be seen from the preceding description that a high reliability heating system has been provided that includes dual furnace control mechanisms wherein each furnace control mechanism includes blowers and control elements and each is independently operable to control the operation of a shared furnace burner unit and heat exchanger; that includes dual furnace control mechanisms and a controller mechanism selector mechanism that detects an abnormal operating condition, malfunction, in the controlling furnace controller mechanism and, in response, automatically switches control to the other furnace controller mechanism; and that includes a controller board selector relay having a relay control input, first and second sets of power switching contacts, and first and second sets of thermostat control signal switching contacts; and first and second controller boards; each of the first and second controller boards having a status LED output that generates a normal operation output signal and an abnormal operation output signal; the first controller board having a power input wired through the first set of power switching contacts of the controller board selector relay and being in signal receiving connection with a first upper limit sensing unit having an upper limit switch and an auxiliary upper limit switch wired in series, a first negative pressure controller, a first flame sensor, and a first thermostat control signal; and in controlling connection with a first main gas valve assembly including a number of series connected roll out switches and a first main gas control valve, a first draft inducer blower having a vacuum connection connected to a vacuum controlled control input of the first negative pressure controller, a first main blower, and a first hot surface ignitor; the second controller board having a power input wired through the second set of power switching contacts of the controller board selector relay and being in signal receiving connection with a second upper limit sensing unit having an upper limit switch and an auxiliary upper limit switch wired in series, a second negative pressure controller, a second flame sensor, and a second thermostat control signal; and in controlling connection with a second main gas valve assembly including a number of series connected roll out switches and a second main gas control valve, a second draft inducer blower having a vacuum connection connected to a vacuum controlled control input of the second negative pressure controller, a second main blower, and a second hot surface ignitor; the relay control input of the controller board selector relay being in controlled connection with the status LED output of the first controller board such that when the first controller board status LED output generates an abnormal operation output signal, such as when a system component fails, the controller board selector relay disconnects the first controller board from the first thermostat control signal and supply power in response to the abnormal operation output signal and connects the second controller board with supply power and the second thermostat control signal switching control of the furnace burner unit and heat exchanger to the second controller board.

It is noted that the embodiment of the high reliability heating system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A high reliability heating system comprising:

a furnace burner unit;

a heat exchanger in heat receiving connection with said furnace burner unit;

first and second furnace control mechanisms, each said first and second furnace control mechanism includes blowers and control elements in functional relationship with said furnace burner unit and said heat exchanger;

each said first and second furnace control mechanism being independently operable to control the operation of said furnace burner unit and said heat exchanger; and a controller mechanism selector mechanism having a control input in connection with said first furnace control mechanism and being in controlling connection with said first and second furnace control mechanism such that, in response to receiving an abnormal operation signal from said first furnace control mechanism, said controller mechanism selector mechanism switches control of said furnace burner unit and said heat exchanger from said first furnace controller mechanism to said second furnace controller mechanism.

2. The high reliability heating system of claim 1 wherein:

said controller mechanism selector mechanism includes a controller board selector relay having a relay control input, first and second sets of power switching contacts, and first and second sets of thermostat control signal switching contacts; and said first and said second furnace control mechanisms include, respectively, a first and a second controller board;

each of said first and second controller boards having a status LED output that generates a normal operation output signal and an abnormal operation output signal;

said first controller board having a power input wired through said first set of power switching contacts of said controller board selector relay and being in signal receiving connection with a first upper limit sensing unit having an upper limit switch and an auxiliary upper limit switch wired in series, a first negative pressure controller, a first flame sensor, and a first thermostat control signal; and in controlling connection with a first main gas valve assembly including a number of series connected roll out switches and a first main gas control valve, a first draft inducer blower having a vacuum connection connected to a vacuum controlled control input of said first negative pressure controller, a first main blower, and a first hot surface ignitor;

said second controller board having a power input wired through said second set of power switching contacts of said controller board selector relay and being in signal receiving connection with a second upper limit sensing unit having an upper limit switch and an auxiliary upper limit switch wired in series, a second negative pressure controller, a second flame sensor, and a second thermostat control signal; and in controlling connection with a second main gas valve assembly including a number of series connected roll out switches and a second main gas control valve, a second draft inducer blower having a vacuum connection connected to a vacuum controlled control input of said second negative pressure controller, a second main blower, and a second hot surface ignitor;

said relay control input of said controller board selector relay being in controlled connection with said status LED output of said first controller board such that when said first controller board status LED output generates an abnormal operation output signal, such as when a system component fails, said controller board selector relay disconnects said first controller board from said first thermostat control signal and supply power in response to said abnormal operation output signal and connects said second controller board with supply power and said second thermostat control signal switching control of said furnace burner unit and heat exchanger to said second controller board.

* * * * *